US010975678B2

(12) United States Patent
Burger et al.

(10) Patent No.: US 10,975,678 B2
(45) Date of Patent: Apr. 13, 2021

(54) PRODUCTION WELL APPARATUS FOR UNDERGROUND COAL GASIFICATION AND USE THEREOF

(71) Applicant: ZHONGWEI (SHANGHAI) ENERGY TECHNOLOGY CO. LTD, Shanghai (CN)

(72) Inventors: Casper Jan Hendrik Burger, Shanghai (CN); Zhenhua Min, Shanghai (CN); Yuanli Wang, Shanghai (CN)

(73) Assignee: ZHONGWEI (SHANGHAI) ENERGY TECHNOLOGY CO. LTD, Shanghai (CN)

( * ) Notice: Subject to any disclaimer, the term of this patent is extended or adjusted under 35 U.S.C. 154(b) by 148 days.

(21) Appl. No.: 16/327,657

(22) PCT Filed: Aug. 24, 2016

(86) PCT No.: PCT/CN2016/096482
§ 371 (c)(1),
(2) Date: Feb. 22, 2019

(87) PCT Pub. No.: WO2018/035733
PCT Pub. Date: Mar. 1, 2018

(65) Prior Publication Data

US 2019/0186250 A1 Jun. 20, 2019

(51) Int. Cl.
*E21B 36/00* (2006.01)
*E21B 43/295* (2006.01)
(Continued)

(52) U.S. Cl.
CPC ..... *E21B 43/295* (2013.01); *E21B 36/001* (2013.01); *E21B 47/06* (2013.01); *E21B 47/07* (2020.05)

(58) Field of Classification Search
CPC ..... E21B 47/06; E21B 36/001; E21B 43/295; E21B 47/065; E21B 43/16; E21B 47/00; E21B 47/07; E21C 43/00
See application file for complete search history.

(56) References Cited

U.S. PATENT DOCUMENTS 3,240,270 A * 3/1966 Marx ..... E21B 36/001 166/250.15
3,343,598 A * 9/1967 Meldau ..... E21B 36/001 166/53
(Continued)

FOREIGN PATENT DOCUMENTS

GB 807195 A * 1/1959 ..... E21B 43/295
GB 2501074 A * 10/2013 ..... E21B 43/295
WO WO-2013090979 A1 * 6/2013 ..... E21B 43/243

OTHER PUBLICATIONS

International Search Report; PCT/CN2016/096482; dated May 25, 2017.

*Primary Examiner* — Daniel P Stephenson
(74) *Attorney, Agent, or Firm* — Dunlap Bennett & Ludwig, PLLC; Brendan E. Squire

(57) ABSTRACT

A production well apparatus for underground coal gasification and an underground coal gasification method using same. The production well apparatus comprises a well head apparatus, a sleeve (8), a product pipe (1), a coolant pipe (3), and a monitoring meter system (7). Coolant is injected, during underground coal gasification, to be in contact and mixed with product gas, and the product gas is discharged after cooled, such that the operation is safer and more controllable. Moreover, most of the components of the production well apparatus can be completely or partially recycled and reused after the gasification is completed.

18 Claims, 3 Drawing Sheets

(51) Int. Cl.
*E21B 47/07* (2012.01)
*E21B 47/06* (2012.01)

(56) References Cited

U.S. PATENT DOCUMENTS

| | | | | | |
|---|---|---|---|---|---|
| 3,856,084 | A * | 12/1974 | Parsons | E21B 7/14 | 166/257 |
| 3,952,802 | A * | 4/1976 | Terry | E21B 43/243 | 166/262 |
| 3,981,362 | A * | 9/1976 | Allen | E21B 43/247 | 166/260 |
| 4,566,536 | A * | 1/1986 | Holmes | E21B 43/243 | 166/250.15 |
| 10,711,587 | B2 * | 7/2020 | Burger | E21B 43/168 | |
| 2010/0139915 | A1 * | 6/2010 | Dreher, Jr. | E21B 43/243 | 166/256 |
| 2019/0186250 | A1 * | 6/2019 | Burger | E21B 36/001 | |
| 2019/0186251 | A1 * | 6/2019 | Min | E21B 43/305 | |

* cited by examiner

PRODUCTION WELL APPARATUS FOR UNDERGROUND COAL GASIFICATION AND USE THEREOF

TECHNICAL FIELD

This invention provides a production well apparatus for the underground coal gasification process. In particular, this invention provides production well equipment to extract production gas after injecting coolant to reduce its temperature during the underground coal gasification process. This invention also provides the application of the production well equipment during the underground coal gasification process.

BACKGROUND ART

Underground coal gasification (UCG or ISC) is a process by which a coal seam is converted into a product gas (also called raw syngas), by combusting and gasifying the in-situ coal seams in the presence of an oxidant. The product gas can be used for various applications, including fuels production, chemical production and power generation. Given the increasingly stringent environmental requirements for the mining industry and the associated labor and capital costs, this UCG technology, which is suitable for most coal reserves, is undoubtedly attractive.

Whether the coal gasification process is conducted underground or on the surface, coal is converted through a series of chemical reactions, wherein $H_2O$ and $CO_2$ are the main gasification agents and $O_2$ as the main oxidant:

$C+O_2 \rightarrow CO_2$ (Complete oxidation reaction)

$C+\frac{1}{2}O2 \rightarrow CO$ (Partial oxidation reaction)

$C+H_2O \rightarrow H_2+CO$ (Steam gasification reaction)

$C+2H_2 \rightarrow CH_4$ (Hydrogen gasification reaction)

$C+CO_2 \rightarrow 2CO$ (Carbon dioxide gasification reaction)

$CO+H_2O \leftrightarrow H_2+CO_2$ (Water gas shift reaction)

$CO+3H_2 \leftrightarrow CH_4+H_2O$ (Methanation reaction)

During the UCG process, a sub-surface completed UCG well system is generally set up in the coal seam. The above-mentioned completed well system includes an injection well for injecting a variety of agents such as oxidant, gasification agent and coolant etc.; a production well for extracting product gas; and other auxiliary support wells, wherein the injection well, production well and support wells are usually fitted with a casing and/or well liner and are connected as required, wherein the support wells generally include an ignition well, coolant delivery well, monitoring well and a guard well. The injection well is usually a horizontal directional well. The production well and support wells are usually horizontal directional wells or vertical wells.

Therefore, during the UCG process, the most basic well completion system consists of an injection well, a production well and a substantial horizontal wellbore linking each other and to be completed with casing and/or well liner, which is typically referred to as an underground coal gasification unit or a well pair.

During the UCG process, the relevant sub-surface zones includes a combustion zone, a gasification zone and a pyrolysis zone, wherein: the combustion zone generally extends from the point of oxidant and gasification agent injection where coal is combusted and gasified in the presence of the oxidant and gasification agent; the gasification zone where coal is gasified and partially oxidized to produce product gas is located downstream of combustion zone or radically around combustion zone; the pyrolysis zone where coal is pyrolyzed is located downstream of the gasification zone. For an ideal UCG process, it is generally desirable to have as little pyrolysis as possible. As coal is consumed or gasified, an UCG cavity within the coal seam develops and gradually grows in size. Finally, the sub-surface coal reserve is completely consumed, leaving only coal ash.

During the UCG process, the produced product gas usually includes CO, $CO_2$, $H_2$, $CH_4$ and solid particles, water, coal tar and hydrocarbon, and small amount of $H_2S$, $NH_4$ and COS etc. The specific composition of the above-mentioned product gas is dependent on multiple factors, including the oxidant (e.g. air, oxygen-enriched air, or pure oxygen), presence of water (coal inherent moisture or ingress water from surrounding strata), coal quality, and process parameters (temperature and pressure, etc.).

During the UCG process, due to the strong exothermic nature of the gasification process, the product gas produced usually has extremely high temperatures, typically 700-800° C. and sometimes even up to 1000° C. As the production well directly contacts the high-temperature product gas, it encounters a variety of challenges caused by such high temperature and heat duty, including thermal damage, wet and hot corrosion damage to relevant components of the production well. For example, when the absolute high temperature, such as 700° C., exceeds the yield stress failure temperature of the production casing material, causing damage to the production well; thermal expansion and/or thermal elongation causing damage to the casing and/or cement layer; thermal elongation causes bending of the production casing for the production well; and wet corrosive product gas causes deterioration and damage to the production well integrity, such as particles and high velocity gas erosion, hydrogen embrittlement or hydrogen induced cracking, chloride ion pitting corrosion, sulfide ($H_2S$) stress corrosion cracking, $CO_2$ corrosion and dissimilar metal galvanic corrosion.

Therefore, for the production well equipment used in the UCG process, if it can better cope with the high temperature wet corrosive product gas, it can prevent and reduce various problems that may occur and/or can recycle and reuse some of the components after sealing or abandonment which is undoubtedly very beneficial.

AU2014100615 provides a UCG product gas-cooling method and apparatus in which the product gas temperature is lowered to change the physical and/or chemical properties of the product gas before it reaches the production well. The coolant flow is injected into the product gas stream primarily through a support well located downstream of the operating gasification zone and upstream of the production well to reduce the product gas temperature from about 500-1200° C. to about 200-400° C. It can be seen that the patent uses a support well to inject coolant flow to cool the product gas, and due to the existence of a separate support well, this design is undoubtedly costly and relatively complicated in structure.

Therefore, for the prior art in the UCG process, the production well equipment used therein still needs improvement, especially how to deal with the high temperature wet corrosive product gas generated by gasification.

SUMMARY OF INVENTION

In view of the prior art, this invention provides production well apparatus for the underground coal gasification process. In particular, this invention provides production well equipment to extract production gas after injecting coolant to reduce its temperature, during the UCG process. This invention also provides the operation method of the production well equipment during the UCG process.

This invention provides a production well apparatus for the UCG process. The production well includes a wellhead, casing, production tubing, coolant tubing, and a monitoring instrumentation system located in the casing, wherein:

The above-mentioned casing is used to reinforce and isolate the production wellbore, which is connected by threaded couplings. The casing is fixed inside the production wellbore using a cement layer;

The above-mentioned production tubing is used for extracting the product gas produced by gasification from the production well to the surface, and has a perforated section at the tip;

The above-mentioned coolant tubing is used for injecting coolant into the production well to cool down the product gas generated by gasification, and is connected with a coolant nozzle at the tip;

The above-mentioned monitoring instrument system extends downward from the wellhead and is fixed near the starting point of the perforated section at the tip of the production tubing. It includes temperature, pressure, and acoustic sensors installed inside the protective tubing; and The above-mentioned wellhead has a gas tight seal with the casing and includes the instrument compression fitting ports for the monitoring instrumentation system, the production gas outlet for production tubing, the casing annulus outlets for the casing, and the coolant inlets for the coolant tubing;

There is a product gas quenching zone located downstream of the coolant nozzle, wherein the product gas produced by gasification is cooled by the coolant sprayed out through the coolant nozzle. The required condition is that the expansion caused by the expected thermal effect and/or gravity effect and/or elongation does not affect the freedom of the components themselves and the relative position between the components.

This invention also provides the UCG method, wherein a completed well system for UCG is provided in the subsurface coal seam, wherein the production well in this invention is utilized, wherein the coolant is injected into the production well through the coolant tubing to quench the product gas produced by gasification and the quenched product gas is extracted to the surface through the production tubing. The above-mentioned coolant can be selected from water, steam, carbon dioxide, inert gases or liquids, and the quenched product gas at room temperature. The injection flow rate of the coolant must be sufficient to ensure the downhole temperature is lower than the set point.

According to this invention, a coolant tubing is included in the production well, whereby the high temperature product gas generated by gasification can be instantly cooled by injecting coolant into the production well, during the UCG process. For example, by controlling the coolant flow rate, the product gas can be cooled from an initial temperature of about 700-1000° C. to less than 400° C., which greatly reduce the subsequent heat load of the production well especially the production tubing and improving the operating environment and operating life of the production well. Finally, it can improve the reliability and safety of the UCG process, which brings improvements to the prior art.

In addition, according to this invention, the operation of the production well apparatus is safer and more controllable by optimizing the design, material selection and application of the components for the production well and the application of the production well itself. Most components such as the wellhead, production tubing, coolant tubing and monitoring instrument system can be recycled and reused in whole or in part after the decommissioning of the UCG process. Thereby, it will reduce the equipment cost of the UCG process and brings advancement to the prior art.

BRIEF DESCRIPTION OF DRAWINGS

The invention is further described below with reference to the accompanying drawings, wherein.

In the Figures, like reference numerals refer to like parts. In particular, the reference numerals involved in the respective Figures have the following meanings.

Figure 1:
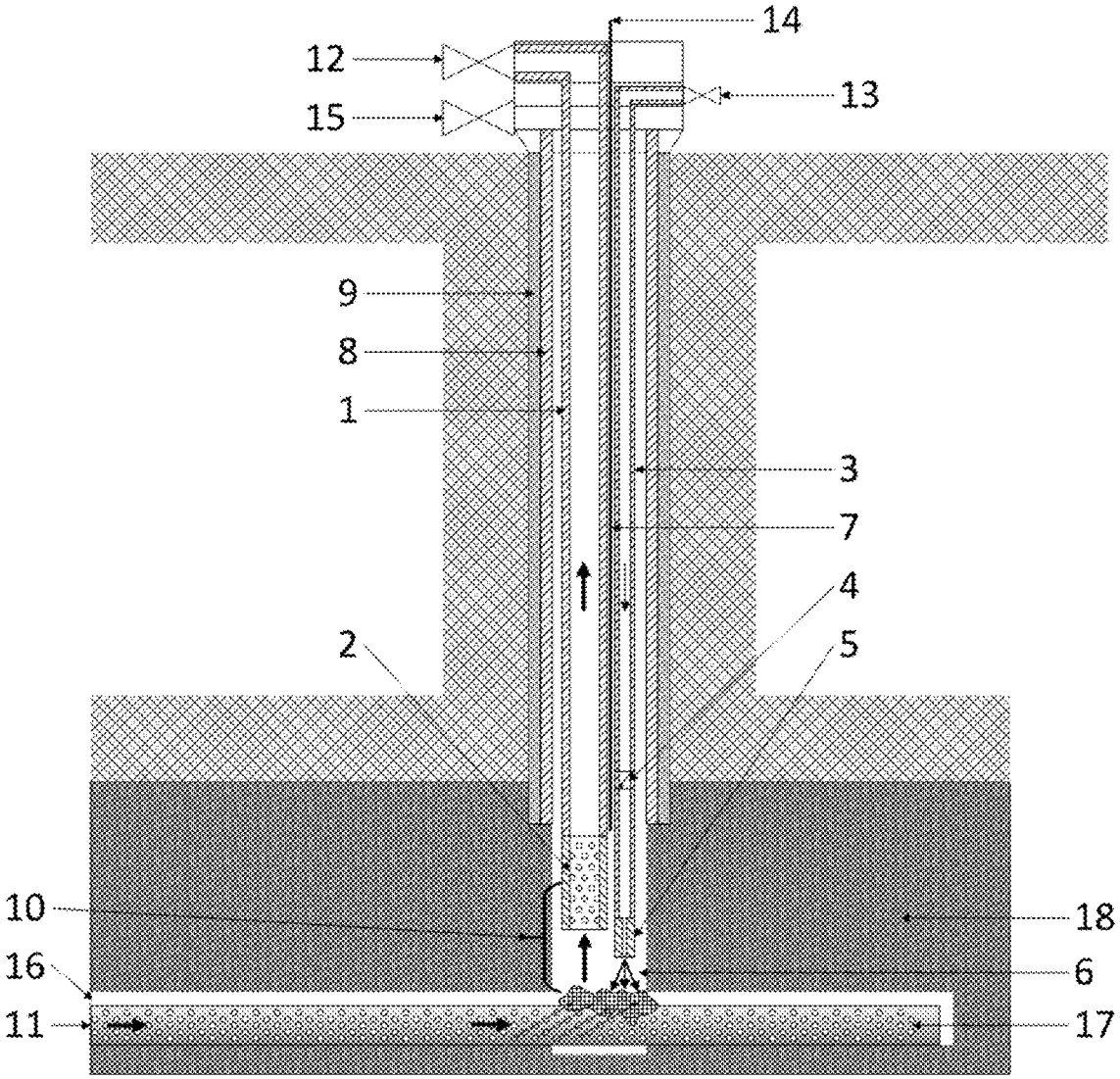
FIG. 1 is a cross-sectional view of a sub-surface portion of an embodiment of a production well apparatus of this invention, wherein the production well is a vertical production well, and wherein the product gas quenching zone is located at the bottom of the production well.

1. Production tubing; 2. Perforated section of the production tubing; 3. Coolant tubing; 4. None-return valve; 5. Coolant nozzle; 6. Coolant; 7. Monitoring Instrumentation system; 8. Production well casing; 9. High temperature cement; 10. Product gas quenching zone; 11. Product gas from the gasification zone; 12. Production tubing outlet; 13. Coolant inlet; 14. Monitoring Instrumentation system port; 15. Production well casing annulus outlet; 16. Injection well coal seam borehole; 17. Perforated section of the injection well liner; 18. Coal seam; 19. The baffle plate (located in the perforated section of the production tubing, guiding the product gas into the production tubing after passing through the product gas quenching zone); 20. Uncemented free casing section of the production well; 21. Production well coal seam borehole; 22. The gap between the perforated section of the production tubing and the perforated section of the production well liner (i.e. the product gas cooling gap zone); 23. Perforated section of the production well liner.

SUMMARY OF INVENTION

This invention provides a production well apparatus for the underground coal gasification process. In particular, this invention provides the production well equipment to extract production gas after injecting coolant to reduce its temperature during the UCG process. This invention also provides the operational method for the production well equipment during the UCG process.

According to this invention, a production well apparatus is provided for the UCG process. The production well includes a wellhead, casing, production tubing, coolant tubing, and a monitoring instrumentation system located in the casing, wherein:

The above-mentioned casing is used to reinforce and isolate the production wellbore, which is connected by threaded couplings. The casing is fixed inside the production wellbore using a cement layer;

The above-mentioned production tubing is used for extracting the product gas produced by gasification from the production well to the surface, and has a perforated section at the tip;

The above-mentioned coolant tubing is used for injecting coolant into the production well to cool down the product gas generated by gasification, and is connected with a coolant nozzle at the tip;

The above-mentioned monitoring instrument system extends downward from the wellhead and is fixed near the starting point of the perforated section at the tip of the production tubing. It includes temperature, pressure, and acoustic sensors installed inside the protective tubing; and The above-mentioned wellhead has a gas tight seal with the casing and includes the instrument compression fitting ports for the monitoring instrumentation system, the production gas outlet for production tubing, the casing annulus outlets for casing, and the coolant inlets for the coolant tubing;

There is a product gas quenching zone located downstream of the coolant nozzle, wherein the product gas produced by gasification is cooled by the coolant sprayed out through the coolant nozzle. The required condition is that the expansion caused by the expected thermal effect and/or gravity effect and/or elongation does not affect the freedom of the components themselves and the relative position between the components.

According to this invention, the UCG method is also provided, wherein a completed well system for UCG is provided in the sub-surface coal seam, wherein the production well in this invention is utilized, wherein the coolant is injected into the production well through the coolant tubing to quench the product gas produced by gasification and the quenched product gas is extracted to the surface through the production tubing. The above-mentioned coolant can be selected from water, steam, carbon dioxide, inert gases or liquids, and the quenched product gas at room temperature. The injection flow rate of the coolant must be sufficient to ensure the downhole temperature is lower than the set point.

According to this invention, the above-mentioned production well is a vertical production well or a horizontal directional production well. For the two types of production wells, the main components are basically the same, but some parts could have some differences in the specific design details.

In addition, the treated gas in the production well is high temperature, wet and corrosive product gas as generated by the UCG process, hence, the entire production well and its components are mostly in this high temperature, wet and corrosive gas environment. Except for the material selection for high temperature and humidity corrosion resistance, the potential size changes due to thermal effects (such as thermal expansion and/or thermal elongation) and/or gravity effects (such as suspension weight) should be considered during the design of the production well components, e.g. leaving expansion space and/or elongation clearance.

Furthermore, since this invention fully optimizes the design, material selection and application of the components of the production well, most of the components can be recovered and re-used in whole or in part after the decommissioning of the UCG process, which is the advantages of the production well of this invention.

According to this invention, the above-mentioned casing extends from the wellhead into the coal seam and is an outer casing of the production well which houses the production tubing, the coolant tubing and the monitoring instrumentation system of the production well; The casing threaded couplings and cement bond layers should be suitable for the downhole high-temperature environment of the production wells, therefore high-temperature gas tight threaded casing, couplings and high-temperature cement are required. In addition, there is an annulus between the inner wall of the casing and all tubing strings, where during ignition, the annulus is usually purged with an inert gas such as nitrogen to prevent the back flows of the downhole fluids such as product gases and/or coolant from entering. During abnormal operation, the casing annulus can be used as a pressure relief channel for the entire well system. At this time, the downhole fluids such as product gas can flow through the annulus to exit at surface, resulting in releasing and mitigating pressure throughout the well system to prevent the formation/coal seam from being subjected to excessive pressure.

According to this invention, the material of the casing is generally selected on the basis of the high temperature, wet and corrosive gas contacted by the inner annulus of the casing when it is used as a relief channel for abnormal operation. The high temperature, wet and corrosive gas resistance is required to ensure the integrity of the whole well system during the operational period, in which the operational period includes the shutdown, decommission, the equipment removal, the well plugging and abandonment. The inner diameter of the casing shall generally be sufficient to accommodate the production tubing, coolant tubing, and monitoring instrumentation systems with appropriate clearance for the thermal expansion of the tubing strings. For example, when the outer diameter of the production tubing is 4.5 inches, the outer diameter of the coolant pipe is 2 inches, and the outer diameter of the protective tubing of the monitoring instrumentation system is 0.75 inches, the inner diameter of the casing can be 9.625 inches. In addition, the additional outer casings such as the conductor casing, surface casing and intermediate casing is used to further enhance the strength of and isolate the well bore according to the formation characteristics such as the aquifer properties and/or formation porosity. In general, the wall thickness of the above-mentioned casings should meet the requirements of drilling and completion operations, and be able to withstand pressures higher than the lithostatic pressure.

According to this invention, for the vertical production well, the above-mentioned casing usually extends from surface, with a cement bond to the formation, to the top of the coal seam. In which case, the entire length of the production well has casing and a cement layer bonded to the formation. For the horizontal directional production well, the above-mentioned casing usually extends from surface, with a cement bond to the formation, to the horizontal position within the coal seam or to the position parallel to the floor of the coal seam for dipping coal seams. This is followed by an uncemented free casing section in the production well. Finally, there is the casing-free coal borehole section extending to the tip of the production well.

According to this invention, the above-mentioned wellhead is the external interface of the production well. It is generally thread-connected to the casing via a graphite gasket for a gas tight seal with the casing and to ensure the gas tightness of the production well, wherein the wellhead includes the instrumentation compression fitting port for the monitoring instrumentation system, product gas outlet for production tubing, casing annulus outlet for the casing, and coolant inlet for the coolant tubing. These components of the production well are integrated into the wellhead and connect the surface facilities through the wellhead.

According to this invention, the wellhead is generally a high temperature and high pressure wellhead to adapt to the high temperature and high pressure working environment of the well. For example, the rated pressure capacity of the wellhead should be designed to satisfy at least the lithostatic pressure and operating temperature which is generally 180-350° C. The material of the equipment should generally be resistant to solid particle erosion, high temperature and wet corrosive gas environments. The wellhead can generally be removed after the end of the production well life (e.g. after well plugging or well abandonment) and can be re-used after further treatment such as refurbishment.

According to this invention, the monitoring instrumentation system is used to monitor related signals in the production well such as temperature, pressure and acoustic waves and transfer the measured signals back to the wellhead control system and store the data in a database, wherein the relevant temperature, pressure and acoustic sensors are usually installed inside the protective tubing and then insert into the downhole area.

In the downhole area, the monitoring instrumentation system is typically attached to the production tubing, e.g. generally near the beginning of the perforated section of the production tubing. In this case, the monitoring instrumentation system is located downstream of the product gas quenching zone, resulting in the measured temperature to be the temperature of product gas after cooling. Generally, the measured temperature should be in the range of the set temperature of 300-350° C. In addition, due to the use of the protective tubing, the monitoring instrumentation system can generally be recycled and reused after the UCG process is completed.

According to this invention, the temperature, pressure and acoustic sensors can be distributed sensing fibers based on Optical Time-Domain Reflectometry (OTDR), which can obtain the corresponding temperature curves, pressure curves and acoustic curves to monitor the production well and control the UCG process. The temperature sensor may additionally or alternatively be a bimetallic sheathed K-type duplex probe thermocouple.

According to this invention, the functions of the temperature, pressure and acoustic sensors in the monitoring instrument system are described as follows:

The temperature sensor monitors the temperature distribution in the production well, wherein: The target measurement point on the production tubing is to measure the temperature near the starting point of the perforated section of the production tubing (the temperature of the cooled product gas entering the production tubing from downstream of the product gas quenching zone), which is usually used to control the coolant flow rate to ensure that the temperature is below the set value (typically 300-350° C.); The production wellhead temperature corresponds to the product gas temperature in the production tubing and in the casing annulus, which can also be used to control the coolant flow rate. For example, the wellhead temperature can be controlled to be lower than a set value (usually 180-350° C.) by increasing the coolant flow rate; In addition, both the target measurement point temperature on the production tubing and the production wellhead temperature can be used for the safety system. When the measured temperature exceeds their set values (usually 300-350° C. and 180-350° C., respectively), the oxidant injection can be immediately cut off to stop the gasification process.

The pressure sensor is used to monitor the pressure distribution in the production well. It can also be used to detect damage of the monitoring instrument system protective tubing, caused by underground pressures. In addition, since the wellhead pressure is always lower than the downhole pressure, the wellhead pressure signal can be used as an indication of the downhole production tubing pressure and the casing annulus pressure.

Acoustic sensors are used to monitor downhole conditions of the production well, such as unexpected situations including casing or production tubing damages (e.g. cracking or bending, etc.), the production tubing blockage due to solid particles or liquid slugs etc., to respond to these events in a timely manner with treatment options.

The above-mentioned monitoring instrumentation system is typically connected through the monitoring instrument port on the wellhead using a compression fitting. In addition, the wellhead monitoring instrumentation that is part of the wellhead control system must have a local instrument display to ensure that the downhole conditions of the production well can still be monitored even when other systems are offline, thereby ensuring that the entire production well can be operated and remain within control.

According to this invention, the above-mentioned production tubing is connected to the production well through a wellhead hanger. Specifically, the production tubing is freely suspended at the center of the wellhead hanger for transferring product gas from the production well to the surface. It is the main flow path for the product gas to the surface during the normal operation.

In the UCG process, the produced product gas is still a high temperature and wet corrosive gas even after quenching. This invention uses the production tubing as the product gas flow path to avoid direct contact between the inner wall of the casing and the high temperature and wet corrosive product gas, thereby protecting the casing to a certain extent. However, this also leads to having high material selection requirements of the production tubing. Specifically, the material of the production tubing must withstand the high temperature and wet corrosive gas environment. The corrosive environment includes, for example, high temperature hydrogen corrosion, stress corrosion cracking (hydrogen embrittlement or hydrogen induced cracking, sulfide stress corrosion cracking ($H_2S$ and COS, etc.) and chloride stress corrosion cracking (HCl, etc.)), acid gas corrosion ($CO_2$, $H_2S$, $H_2SO_4$, HCl, etc.), dew point corrosion, ammonium chloride and ammonium hydrogen sulphate corrosion, sulfidation corrosion, carburization corrosion, dissimilar metal galvanic corrosion, and erosion caused by solid particles and/or high velocity gases; Furthermore, as the production tubing is freely suspended in a high temperature environment, the length changes of the production tubing caused by thermal effects and/or gravitational effects must be considered in the design in order to ensure the freedom of the production tubing and prevent bending, and also to ensure the relative design positions between the production tubing and other components, for example, to ensure the relative position between the coolant nozzle and the perforated section of the production tubing. As the production tubing uses a high grade of temperature and corrosion resistant materials, the production tubing in this invention is generally recyclable and reusable after the UCG process is completed.

In addition, in the design of the production tubing of this invention, the inner diameter of the production tubing is generally determined based on the maximum flow rate of the product gas (i.e. the corresponding product gas flow rate at the maximum oxidant injection flow rate) and the corresponding maximum quenching requirement of the product gas. The maximum flow rate represents the maximum production capacity of the relevant UCG process; under the conditions of satisfactory self-supporting of the tubing weight, downhole operating requirements and maximum design pressure, the minimum wall thickness of the production tubing is selected based on the standard outer diameter size and weight of the production tubing; The minimum flow rate of the product gas in the turn down operating mode (i.e. the corresponding product gas flow rate at the minimum oxidant injection flow rate) is to ensure that the product gas flow is sufficient to entrain the liquid and solid impurities to surface and to prevent blockage of the production tubing. The minimum flow rate of the product gas represents the lowest production capacity of the UCG in turn down operating mode.

According to this invention, the tip of the production tubing is usually the perforated section to facilitate product gas from entering the production tubing and subsequently being transported to the surface. The length of the perforated section at the tip of the production tubing is generally about 1-4 complete tubing lengths. The diameter of the holes on the perforated section can be 5 to 35 mm, preferably 10 to 25 mm. The holes can be distributed at a staggered interval with the total open area of the holes between 5 to 35%, preferably 10 to 30% of the total wall area of the perforated section.

According to this invention, the above-mentioned coolant tubing is also connected to the production well by the wellhead hanger. Specifically, the coolant tubing is freely suspended parallel to the production tubing at an eccentric position of the wellhead hanger for injecting coolant into the production well to cool the product gas produced by gasification and a coolant nozzle is connected at the tip of the coolant tubing.

According to this invention, the inner diameter of the above-mentioned coolant tubing is generally determined based on the coolant flow rate and the corresponding structural integrity requirements. The material of the coolant tubing is generally stainless steel or higher-grade corrosion resistant material. Therefore, the coolant tubing can also be recycled and reused after the end of the UCG process.

According to this invention, one or more non-return valves can be installed on the above-mentioned coolant tubing to prevent reverse flow of gas into the coolant tubing, wherein multiple non-return valves are primarily used as redundancy. The above-mentioned non-return valve typically has a range of crack pressures that can be used to maintain pressure within the coolant tubing, while ensuring pressure relief to the product gas quenching zone when the pressure within the coolant tubing increases. In order to protect the non-return valve, for example to avoid damage to its integrity, the position of the non-return valve is typically located in the low temperature region of the production well casing, e.g. between the wellhead and the perforated section of the production tubing. The above-mentioned non-return valve can be any type of non-return valve known to those skilled in the art, such as a spring flapper valve, or a ball+spring type, etc.

According to this invention, the coolant nozzle at the tip of the above-mentioned coolant tubing is downstream of the product gas quenching zone. The coolant nozzle can inject the coolant into the product gas quenching zone, resulting in sufficient cooling of the product gas by contacting and mixing with coolant before entering the production tubing. In addition, it shall be emphasized that the relative position changes between the coolant nozzle and other components caused by thermal effects and/or gravity effects must be taken into consideration when determining the position of the coolant nozzle, to ensure that the coolant can be effectively injected all the way into the downstream product gas quenching zone, to cool the product gas.

Specifically, according to this invention, starting from the wellhead, for a vertical production well, the above-mentioned coolant nozzle is located below the perforated section of the production tubing; and for a horizontal directional production well, the coolant nozzle is located at the tip of the production tubing within the perforated section.

According to this invention, the above-mentioned coolant nozzle can be any type of nozzle known to those skilled in the art or can be specifically designed. For example, it can be a single-hole nozzle or a multi-hole nozzle. The diameter of each hole in the nozzle is generally greater than or equal to 5 mm to prevent nozzle blockage caused by fouling or the like, wherein a multi-hole nozzle is preferred, and a plurality of holes on the multi-hole nozzle can be distributed centrally and peripherally. The outer peripheral holes can be parallel to the central hole such that the injected coolant is narrowly focused into the product gas quenching zone; or the outer peripheral holes can be diverged outward at an angle to the central hole, such as 5-35°, preferably 8-20°. Therefore, the injected coolant can enter the product gas quenching zone with a larger coverage. With this specifically selected or designed coolant nozzle, the coolant can be better contacted and mixed with the product gas to allow the product gas to be rapidly cooled to the target temperature.

According to this invention, the coolant used can be any type of coolant known to those skilled in the art. Generally, the coolant is selected on the basis of cost savings and favorable to the downstream treatment of product gas. For example, the coolant can be selected from water, steam, carbon dioxide, inert gas or liquid, and the quenched product gas at room temperature, etc. The injection flow rate of the above-mentioned coolant is generally controlled by the expected temperature of the quenched product gas. In other words, the injection flow rate of the above-mentioned coolant must be sufficient to cool the product gas temperature to below the set temperature, which is typically 300-350° C.

According to this invention, when water and/or carbon dioxide is used as the coolant, they can be recovered and treated at the surface by a separation process and the recovered coolant can be subsequently injected into the production well again. In other words, the recycle of the coolant can be achieved, thereby saving operating cost of the UCG process.

In addition, according to this invention, the quenched product gas at room temperature can be used as a coolant. In this case, not only is a large amount of product gas available for quench purposes, but also the external impurities are not introduced into the product gas at all. Therefore, it is greatly simplifying the downstream treatment process of the product gas, which is extremely beneficial for the entire UCG process.

According to this invention, wherein the product gas quenching zone is located downstream of the coolant nozzle at the tip of the coolant tubing, in the product gas quenching zone, the coolant contacts and mixes with the product gas resulting in reducing the temperature of the product gas. It can generally be reduced from an original temperature of 700-1000° C. to i.e. below 400° C. Then, the cooled product gas is then transported to the surface via the production tubing.

According to this invention, the product gas quenching zone is provided with different arrangements for different production well types to effectively cool the product gas under different conditions. It shall be emphasized that the expansion and/or elongation caused by thermal and/or gravity effects of the production tubing must be considered in the design of the production well, especially the design of the production tubing itself and the relative position with other components in the production well, to ensure the free movement of the production tubing and its required relative position with other components are still satisfied in the presence of expansion and/or elongation of the production tubing.

According to this invention, for a vertical production well, starting from the wellhead: the casing extends to the coal seam near the roof of the coal seam, with a cement bond to the formation. The perforated section length of the production tubing is for about 2-3 complete tubing lengths. The coolant nozzle is located below the perforated section of the production tubing, whereby the product gas quenching zone is located downstream of the coolant nozzle and is basically located at the bottom of the production well and intersects with the perforated section of the injection well liner. In this case, the coolant is transported through the coolant tubing and sprayed out into the product gas quenching zone by the coolant nozzle. The product gas from the gasification zone flows into the product gas quenching zone through the perforated section of the injection well liner. Then the coolant contacts and mixes with the product gas in the product gas quenching zone to cool the product gas and the cooled product gas is transported to the surface through the production tubing.

According to this invention, for a horizontal directional production well, the above-mentioned product gas quenching zone is generally located in the uncemented free casing section of the production well. The casing-free coal seam borehole section is connected to the uncemented free casing section of the production well. The above-mentioned casing-free coal seam borehole section in which the perforated section of the production liner is installed generally extends to the tip of the production well. The perforated section of the production liner is generally used to support the casing-free coal seam borehole section to prevent the collapsing of the coal seam and the blockage of the UCG flow path. The perforated section of the production liner intersects with the perforated section of the injection well liner at the tip of the production well. Therefore, the product gas from the gasification zone flows through the perforated section of the injection well liner and then flows into the perforated section of the production well liner. It then enters the product gas quenching zone, contacting and mixing with the coolant. Finally, the cooled product gas is delivered to the surface through the production tubing.

According to this invention, the perforated section of the production well liner in the casing-free coal seam borehole section is basically sacrificial and will be burned in the direction from the coal seam towards the production well during the gasification process. Therefore, the material selection is not critical. Carbon steel tubing is generally selected.

Furthermore, according to this invention, for the horizontal directional production well, there are two arrangements for the product gas quenching zone located in the uncemented free casing section of the production well. Specifically, they are the baffle plate quenching zone and the gap quenching zone.

According to this invention, for the product gas quenching zone for the horizontal directional production well, when the baffle plate quenching zone is set-up, the above-mentioned perforated section of the production tubing starts from the uncemented free casing section of the production well to the casing-free coal seam borehole section and is connected to the perforated section of the production well liner in the casing-free coal seam borehole section, wherein the baffle plate is installed in the perforated section of the production tubing, preferably at about 1-2 complete tubing lengths away from the end of the perforated section of the production tubing. Therefore, it can enhance the contact and mixing between the product gas and the coolant. In detail, the above-mentioned baffle plate restricts the flow rate while ensuring the communication of the well system. Therefore, after the product gas enters the perforated section of the production tubing through the perforated section of the production well liner, the above-mentioned baffle plate forces the product gas to flow out from the perforated section of the production tubing located upstream of the baffle plate, making contact and mixing with the coolant sprayed out from the coolant nozzle. Then the cooled product gas passes through the perforated section of the production tubing located downstream of the baffle plate into the production tubing and is transported to the surface. The coolant nozzle is located near the baffle plate, preferably within 2.0 meters upstream or downstream of the baffle plate, more preferably within 1.0 meter upstream or downstream of the baffle plate.

According to this invention, for the product gas quenching zone in the horizontal directional production well, when the gap quenching zone is set-up, the above-mentioned perforated section of the production tubing starts from the uncemented free casing section of the production well, but it ends at the location that is about 1-2 complete tubing lengths away to the casing-free coal seam borehole section. Hence, there is a gap between the perforated section of the production tubing and the perforated section of the production well liner, which is used as the product gas quenching zone. The product gas flows directly through the perforated section of the production well liner to the product gas quenching zone, contacts and mixes with the coolant sprayed through the coolant nozzle, and then the cooled product gas enters the production tubing through the perforated section of the production tubing and is transported to the surface. The coolant nozzle is located near the tip of the perforated section of the production tubing, preferably within 2.0 meters upstream or downstream of the tip of the perforated section of the production tubing, more preferably within 1.0 meter upstream or downstream of the tip of the perforated section of the production tubing.

Therefore, according to this invention, the high temperature product gas from the UCG process can be rapidly and effectively cooled down by utilizing the production well including the coolant tubing with the specific coolant nozzles and the uniquely designed product gas quenching zone. Thereby, it can greatly reduce the heat load of the product gas for the downstream treatment, and bringing advancements to the prior art.

Embodiments of the invention are further described below with reference to corresponding figures.

FIG. 1 illustrates an embodiment of the production well equipment in this invention, wherein the above-mentioned production well is a vertical production well, and wherein the product gas quenching zone is located at the bottom of the production well. As shown in FIG. 1, wherein: the high temperature product gas 11 from the gasification zone with a temperature of about 700-1000° C. flows into the product gas quenching zone 10 through the perforated section of the injection well liner 17 and the injection well coal seam borehole 16; the coolant is injected through the coolant inlet 13 at the wellhead on surface, flows down the coolant tubing 3 through the non-return valve 4, and is injected through the coolant nozzle 5 into the product gas quenching zone 10; the non-return valve 4 is provided with a crack pressure to maintain the pressure inside the coolant tubing 3 when there is no coolant injection; the temperature near the starting point of the perforated section of the production pipe tubing 2 is measured by the temperature sensor in the monitoring instrumentation system 7 and feedback is sent to the control system; the coolant 6 contacts and mixes with high temperature product gas in the product gas quenching zone 10 to cool the product gas to 300-350° C.; the cooled product gas enters the production tubing 1 through the perforated section of the production tubing 2 and then exits the wellhead through the production tubing outlet 12 to enter the surface process pipe; the production tubing 1, coolant tubing 3 and monitoring instrumentation system 7 are all installed inside the production well casing 8; the casing 8 is bonded into the production well borehole using the high temperature cement layer 9, which extends from the surface wellhead to the location around the roof of the coal seam 18; the annulus between inner wall of the casing 8, production tubing 1, coolant tubing 3 and the monitoring instrumentation system 7 can be used as an alternate pressure relief pathway during abnormal operation, where the product gas can flow from the casing annulus outlet 15 at the wellhead.

Figure 2:
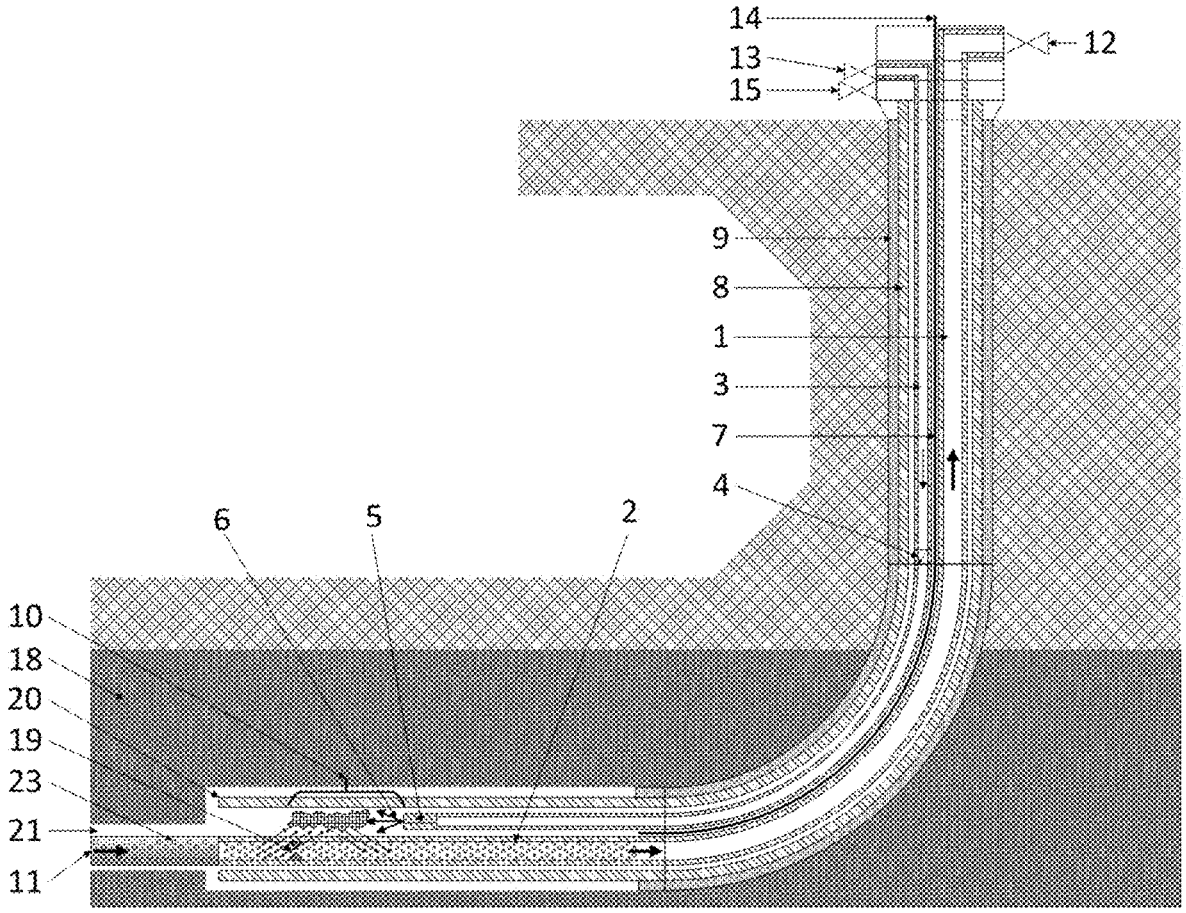
FIG. 2 is a cross-sectional view of a sub-surface portion of another embodiment of the production well apparatus of this invention, wherein the production well is a horizontal directional production well, wherein the product gas quenching zone is located at the tip of the free uncemented casing section of the production well, wherein a baffle is provided in the perforated section of the production tubing to enhance contact and mixing between the product gas and the coolant.

FIG. 2 illustrates another embodiment of the production well equipment in this invention, wherein the production well is a horizontal directional production well, wherein the product gas quenching zone is located at the tip of the uncemented free casing section of the production well. A baffle plate is provided in the perforated section of the production tubing to enhance the contact and mixing between the product gas and the coolant. As shown in FIG. 2, wherein: the product gas quenching zone 10 is located at the tip of the uncemented free casing section of the production well 20; the high temperature product gas 11 with a temperature of about 700-1000° C. from the gasification zone flows through the perforated section of the production well liner 23 and the production well coal seam borehole 21, into the perforated section of the production tubing 2; the baffle plate 19 installed inside the perforated section of the production tubing 2 guides the product gas into the product gas quenching zone 10, where the coolant contacts and mixes with the product gas, and then the product gas and the coolant enter the production tubing 1, through the perforated section of the production tubing 2, located downstream of the baffle plate 19; the temperature near the starting point of the perforated section of the production tubing 2 is measured by the monitoring instrumentation system 7 and feedback is sent to the control system, thereby controlling the coolant flow rate at the coolant inlet 13 to ensure the temperature is lower than a set value (e.g., 300-350° C.). For the horizontal directional production well, the casing 8 is bonded inside the wellbore using the high temperature cement layer 9 which extends from the surface wellhead location to a position parallel to the coal seam floor.

Figure 3:
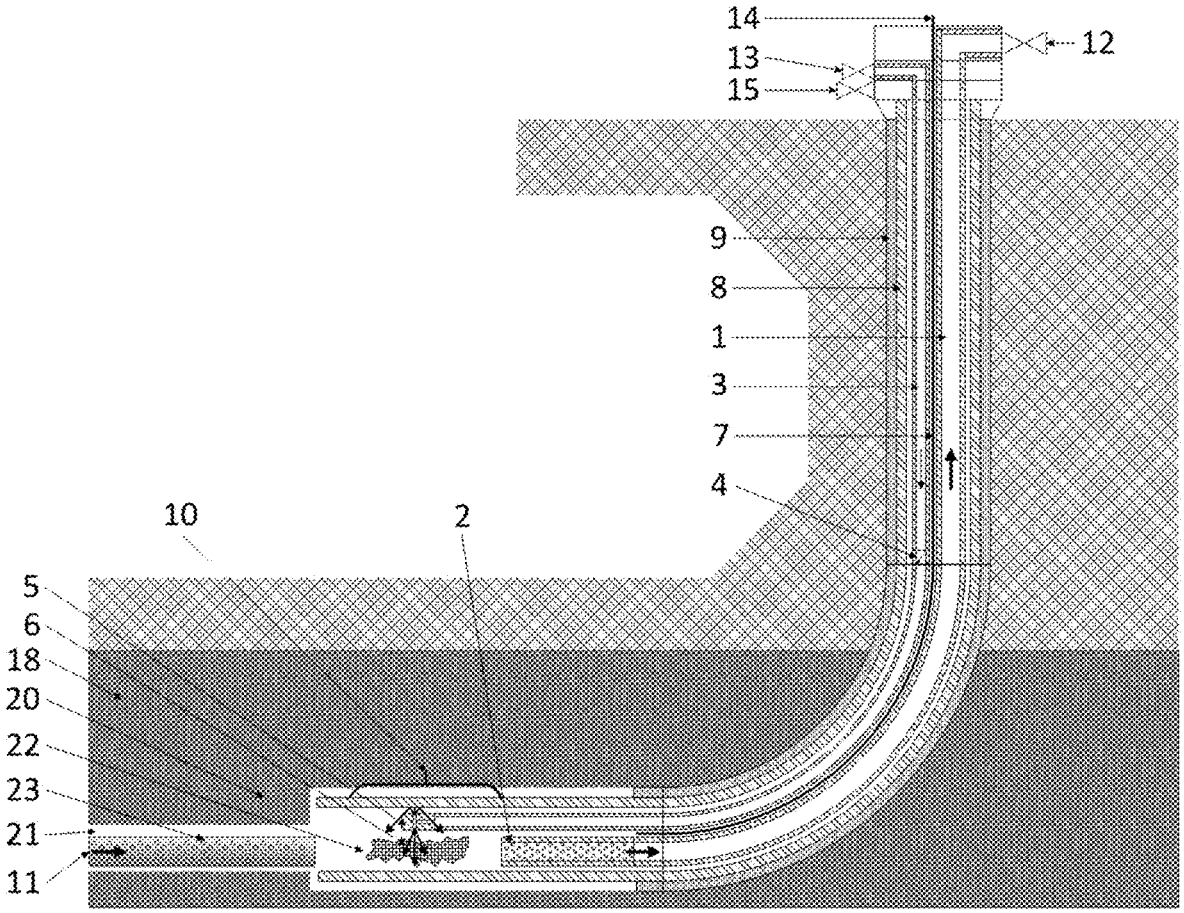
FIG. 3 is a cross-sectional view of a sub-surface portion of another embodiment of the production well apparatus of this invention, wherein the production well is a horizontal directional production well, wherein the product gas quenching zone is located at the tip of free uncemented casing section of the production well, and the gap between the perforated section of the production tubing and the perforated section of the production well liner.

FIG. 3 illustrates another embodiment of the production well equipment in this invention, wherein the production well is a horizontal directional production well, wherein the product gas quenching zone is located at the end of the uncemented free casing section of the production well and the gap between the perforated section of the production tubing and the perforated section of the production well liner. As shown in FIG. 3, wherein: at the end of the uncemented free casing section of the production well 20, the gap 22 is formed between the perforated section of the production tubing 2 and the perforated section of the production well liner 23. The gap 22 forms the product gas quenching zone 10 where the coolant is contacted and mixed with the high temperature product gas; the remaining components are substantially identical to FIG. 2.

The present invention is not limited to the above-mentioned embodiments and various modifications and changes can be made without departing from the spirit and principles of the present invention, where the changes and adjustments should remain within the scope of the present invention.

The invention claimed is:

1. The production well apparatus used for the underground coal gasification process comprising: a wellhead, a casing, a production tubing, a coolant tubing and a monitoring instrumentation system located in the casing, wherein the casing is used to reinforce and isolate the production wellbore, which is connected by threaded couplings, and the casing is bonded in the production wellbore using a cement layer;

the production tubing is used for extracting the product gas produced by gasification from the production well to the surface, and has a perforated section at the tip;

the coolant tubing is used for injecting coolant into the production well to cool down the product gas generated by gasification, and is connected with a coolant nozzle at the tip;

the monitoring instrumentation system extends downward from the wellhead and is fixed near a starting point of the perforated section at the tip of the production tubing, the monitoring instrumentation system comprising temperature, pressure, and acoustic sensors installed inside a protective tubing; and the wellhead has a gas tight seal with the casing, and includes instrument compression fitting ports for the monitoring instrumentation system, the production gas outlet for the production tubing, the casing annulus outlets for the casing, and the coolant inlets for the coolant tubing; and a product gas quenching zone located downstream of the coolant nozzle produced by gasification is cooled by the coolant sprayed out through the coolant nozzle, wherein the expansion caused by the expected thermal effect and/or gravity effect and/or elongation does not affect the freedom of movement and the relative position between the perforated section of the production tubing, the coolant nozzle, and the sensors of monitoring instrumentation system.

2. The production well apparatus in claim 1, further comprises a wellhead hanger which is used for freely suspending the production tubing at the center position and freely suspending the coolant tubing in an eccentric position.

3. The production well apparatus in claim 1, wherein a length of the perforated section at the tip of the production tubing is generally about 1-4 complete tubing lengths, the diameter of each hole on the perforated section is 5 to 35 mm, the holes are distributed at a staggered interval and a total perforated area is 5 to 35% of a total tubing wall area.

4. The production well apparatus in claim 1, wherein one or more non-return valves is installed on the coolant tubing to prevent reverse flow into the coolant tubing, wherein the non-return valve is located at a position just before the perforated section at the end of the production tubing, starting from the wellhead.

5. The production well apparatus in claim 1, wherein the coolant nozzle is a single-hole nozzle or a multi-hole nozzle with a diameter greater than or equal to 5 mm, wherein a plurality of holes on the porous nozzle are distributed centrally and peripherally, and outer peripheral holes are parallel to a central hole or can be diverged outward at an angle to the central hole, such as 5-35°.

6. The production well apparatus in claim 1, wherein the production well is a vertical production well, wherein starting from the wellhead: the casing is bonded by a cement layer and extends to the position near the roof of the coal seam; the length of the perforated section of the production tubing is about 2-3 complete tubing lengths; the coolant nozzle is located below the perforated section of the production tubing; and the product gas quenching zone is located at the bottom of the production well.

7. The production well apparatus in claim 1, wherein the production well is a horizontal directional production well, wherein starting from the wellhead: the casing is bonded through a cement layer and extends into the horizontal position in the coal seam or to a position parallel to the floor of the coal seam, then to the an uncemented free casing section, and finally to the casing- free coal seam borehole section all the way to the tip of the production well, wherein the perforated section of the production tubing is installed in the casing-free coal seam borehole section; and the product gas quenching zone is located in the uncemented free casing section of the production well.

8. The production well apparatus in claim 7, wherein the product gas quenching zone is a baffle plate quenching zone; wherein the perforated section of the production tubing extends from a starting point of the uncemented free casing section all the way to the casing-free coal seam borehole section and is connected to the perforated section of the production tubing; wherein the baffle plate is installed in the perforated section of the production tubing, at about 1-2 complete tubing lengths away from the end of the perforated section of the production tubing, resulting in enhancing contact and mixing between the product gas and the coolant; wherein the coolant nozzle is located near the baffle plate.

9. The production well apparatus in claim 7, wherein the product gas quenching zone is a gap quenching zone; wherein the perforated section of the production tubing extends from the starting point of the uncemented free casing section and stops at around 1-2 complete tubing lengths away from the casing-free coal seam borehole section, wherein a gap between the perforated section of the production tubing and the perforated section of the production tubing is used as the product gas quenching zone and the coolant nozzle is located near the end of the perforated section of the production tubing.

10. An underground coal gasification method, wherein a completed UCG well system is constructed in the subsurface coal seam, wherein the production well apparatus of claim 1 is utilized, wherein the coolant is injected in the production well through the coolant tubing to cool the product gas produced by gasification and the cooled product gas is delivered to the surface through the production tubing, wherein the coolant can be selected from water, steam, carbon dioxide, inert gas or liquid, and the cooled product gas at room temperature and the injection flow rate of the coolant is sufficient to reduce the temperature of the downhole product gas below a set point value.

11. The method in claim 10, wherein the monitoring instrumentation system obtains temperature, pressure and acoustic signals in the production well and sends feedback to a control system near the wellhead; wherein the temperature signal is used to control the coolant flow, the pressure signal is used to monitor the production well downhole pressure and the acoustic signal is used for monitoring the downhole condition of the production well; wherein the temperature, pressure, and acoustic sensors are distributed sensing fibers based on fiber optic time domain reflectometry techniques, and the temperature sensor is additionally or alternatively a bimetallic sheathed K-type dual probe thermocouple; wherein the oxidant injection is immediately cut off to stop the gasification process when the temperature near the starting point of the perforated section at the end of the production tubing and/or the temperature of the production wellhead exceeds their set point values.

12. The method in claim 10, wherein the annular space between the inner wall of the casing and each tubing is purged and blocked with an inert gas such as nitrogen to prevent the product gas and/or coolant from entering during the ignition phase, wherein the casing annulus can be used as a pressure relief channel for the entire well system during abnormal operation to prevent the formation/coal seam from being subjected to excessive pressure.

13. The method in claim 10, wherein for the vertical production well, the product gas quenching zone, located at the bottom of the production well, intersects with the perforated section of an injection well liner, wherein the product gas produced by gasification flows into the product gas quenching zone through the perforated section of the injection well liner, contacts and mixes with the coolant in the product gas quenching zone, and is then transported to the surface through the production tubing, after cooling.

14. The method in claim 10, wherein for the horizontal directional production well, the perforated section of the production well liner in the casing-free coal seam borehole section intersects with the perforated section of an injection well liner, wherein the product gas produced by gasification flows into the perforated section of the production well liner through the perforated section of the injection well liner, contacts and mixes with the coolant in the product gas quenching zone, and then is transported to the surface through the production tubing, after cooling.

15. The method in claim 14, wherein the product gas quenching zone is the baffle plate quenching zone, the product gas enters the perforated section of the product tubing through the perforated section of the production well liner, wherein the baffle plate guides the product gas to flow out from the perforated section of the production tubing, located upstream of the baffle plate, contact and mixes with the coolant sprayed out from the coolant nozzle, then the cooled product gas passes through the perforated section of the production tubing located downstream of the baffle plate, into the production tubing and is transported to the surface.

16. The method in claim 14, wherein the product gas quenching zone is the gap quenching zone, the product gas directly enters the product gas quenching zone through the perforated section of the production well liner, contacts and mixes with the coolant sprayed out from the coolant nozzle and then the cooled product gas passes through the perforated section of the production tubing and is transported to the surface through the production tubing.

17. The method in any of claim 10, wherein water and/or carbon dioxide is used as the coolant, the water and/or carbon dioxide is reinjected into the production well after being recovered and treated on the surface, thereby it is recycling the coolant.

18. The method in any of claim 10, wherein the cooled product gas at room temperature is used as coolant, thereby it avoids the introduction of any external impurities into the product gas and simplifying the product gas downstream treatment process.

* * * * *